US005915879A

United States Patent [19]

Burnett et al.

[11] Patent Number: 5,915,879

[45] Date of Patent: Jun. 29, 1999

[54] REDUCING LEAKAGE THROUGH SANDBAG DIKES USING A BENTONITE OR OTHER CLAY MUD SLURRY

[76] Inventors: Peter G. Burnett, 619 Park Dr., Kenilworth, Ill. 60043; John J. Wanner, 2710 E. Eastman Ave., Denver, Colo. 80210

[21] Appl. No.: 08/933,317

[22] Filed: Sep. 18, 1997

[51] Int. Cl.[6] ..... E02B 3/12; E02D 17/20

[52] U.S. Cl. ..... 405/116; 405/16; 405/21; 405/107

[58] Field of Search ..... 405/16, 17, 21, 405/107, 110, 111, 116, 270

[56] References Cited

U.S. PATENT DOCUMENTS

| | | | |
|---|---|---|---|
| 3,890,802 | 6/1975 | Auriat et al. | 405/117 |
| 3,986,365 | 10/1976 | Hughes | 405/264 |
| 4,279,547 | 7/1981 | Clem | 405/270 X |
| 4,315,703 | 2/1982 | Gasper | 405/264 |
| 4,334,801 | 6/1982 | Gray | 405/157 |
| 4,345,856 | 8/1982 | Tuck | 405/258 |
| 4,362,433 | 12/1982 | Wagner et al. | 405/107 |
| 4,439,062 | 3/1984 | Kingsbury | 588/259 |
| 4,476,276 | 10/1984 | Gasper | 524/500 |
| 4,637,462 | 1/1987 | Grable | 166/245 |
| 4,650,368 | 3/1987 | Bayer | 405/111 |
| 4,787,776 | 11/1988 | Brady et al. | 405/270 |
| 5,130,191 | 7/1992 | Pole | 428/332 |
| 5,183,710 | 2/1993 | Gerbino | 428/405 |
| 5,360,294 | 11/1994 | Carriker et al. | 405/270 |
| 5,462,390 | 10/1995 | Sydansk | 405/264 |
| 5,564,864 | 10/1996 | Simpson et al. | 405/270 |
| 5,584,609 | 12/1996 | Clarey et al. | 405/270 |
| 5,589,257 | 12/1996 | Carriker et al. | 405/270 X |

*Primary Examiner*—Tamara Graysay
*Assistant Examiner*—Tara L. Mayo
*Attorney, Agent, or Firm*—Sheridan Ross P.C.

[57] ABSTRACT

A method for reducing water leakage through sandbag dikes is disclosed, wherein a bentonite or other clay mud slurry is applied to the sandbags. The mud slurry may further include a water loss reducing chemical and/or a water blocking material. The mud slurry may be applied to the river side of the sandbags and may be covered with a plastic sheeting before the river level reaches the sandbags. The mud slurry, and any included chemicals and/or water blocking materials (s), form a coating on both woven plastic fabric and cloth sandbags as well as sandbags of non-porous plastic for reducing water flow through and between the sandbags. The plastic sheeting also makes it feasible to repair the dikes after the sandbags have become submerged by the rising water. That is, hoses can be inserted between the sandbags and the plastic sheeting for injecting the mud slurry at points having excessive leakage.

14 Claims, No Drawings

REDUCING LEAKAGE THROUGH SANDBAG DIKES USING A BENTONITE OR OTHER CLAY MUD SLURRY

FIELD OF THE INVENTION

This invention relates to on-site application of a bentonite or other clay mud slurry to sandbag dikes to reduce water leakage through and around the sandbags.

BACKGROUND OF THE INVENTION

Sandbag dikes are commonly erected along river banks and around valuable properties to prevent flooding. In many instances, leakage through the dikes has been so great that it was very difficult or impossible to pump the water out as fast as it leaks through. Moreover, various techniques have been tried to reduce such leakage. However, there is still a need to reduce such leakage in a cost effective, straightforward manner and which can be provided in a short period of time.

SUMMARY OF THE INVENTION

The inventors have discovered that certain properties of mud slurries such as used in the oil drilling industry are useful in reducing sandbag dike leakage and erosion. For example, when sodium bentonite is mixed with water to form a mud slurry the colloidal gel nature of the slurry is such that it can effectively hold in suspension various water blocking substances such as cottonseed hulls, sawdust, nut shells, leaves, cane fiber, shredded cellophane, and mica flakes. Accordingly, the present invention is a method and system for the on-site application of bentonite or other clay mud slurries, and other comparable substances, to the river side of sandbag dikes to reduce water leakage through and between the sandbags. In particular, various clay or sacked bentonite based mud slurries are within the scope of the present invention. Further note that such clays and sacked bentonite are commonly available throughout North America.

A mud slurry according to the present invention is applied to the sandbags before the river water has risen to the level of the sandbags. Optionally, when, for example, rain is expected, a covering layer of plastic sheeting can be provided to prevent the slurry from being washed away by the rain, this sheeting also being applied before the river water has risen to the level of the sandbags. However, the plastic sheeting need be only anchored in place with sandbags or rock. That is, it is an aspect of the present invention that no attempt need be made to seal the edges to keep the flood water out since once the flood water reaches the sandbags, the mud slurry coating is held in place by the hydrostatic pressure differential across it induced by the river water level.

Accordingly, it is another aspect of the present invention that once a sandbag dike has been prepared as above, or has had plastic sheeting placed on its river water side, more effective repairs to such dikes can be performed when the water level rises to that of the dike. That is, for the weakened portions of a dike requiring repair to prevent excessive leakage and/or erosion, the mud slurry of the present invention can be straightforwardly deposited on the river water side of the dike between the sandbags and the plastic sheeting. In one embodiment of the present invention, the application of the mud slurry can be provided by pumping it through a hose with the outlet placed between a weakened portion of the dike and the plastic sheeting thereon.

It is also an aspect of the present invention that chemicals may be mixed into a slurry of the present invention, wherein such additives may decrease the permeability of the mud coating, thus potentially increasing its effectiveness as a water barrier. In particular, alkaline chemicals such as caustic soda (NaOH) may be added to the mud slurry.

It is another aspect of the present invention that the mud slurry may be provided at a sandbag dike site and deposited on the sandbags using equipment typically readily available. That is, since the mud slurry is flowable, it can be delivered to dike sites via, e.g., cement mixing trucks and can be jetted onto the sandbags in a similar manner to the jetting or depositing of cement in construction work. Thus, the mud slurry can be quickly and cost effectively applied.

It is yet another aspect of the present invention that the constituents of the mud slurries contemplated have the property of readily adhering to the vertical sides of the sandbags, the colloidal gelled mud holding any blocking material in suspension and inhibiting downward movement due to gravity. In particular, the mud slurries contemplated adhere to cloth sandbags and woven plastic fabric sandbags.

Further features and aspects of the present invention will become evident from the accompanying detailed description.

DETAILED DESCRIPTION OF A PREFERRED EMBODIMENT OF THE INVENTION

In one embodiment of the present invention, the clay is bentonite wherein a thick bentonite mud slurry is mixed. Note that the mud slurry may additionally include a water loss reducing chemical(s) and/or blocking material(s). Tests of the water barrier properties of such mud slurries having different compositions were made by applying the slurries to a piece of woven plastic fabric from a sandbag obtained from a dike in Davenport, Iowa. One mud slurry in particular was very effective, reducing the water flow rate to about one percent of the rate through the fabric without any coating. This mud slurry consisted of about 10 parts water to one part bentonite by volume, with the water containing about 0.02 pounds of caustic soda (NaOH) to one gallon of water. Additionally, this slurry included about six parts loose, uncompacted sawdust to each part bentonite (by volume). However, it is believed that other chemicals and water blocking materials may also be effective as a water barrier for such dikes. In particular, the following chemicals and water blocking materials may additionally (and/or alternatively) be added to a mud slurry of the present invention: sodium carbonate and bicarbonate may be used instead of caustic soda, cottonseed hulls, nut shells, leaves, cane fiber, shredded cellophane, and mica may also be used as blocking materials.

It is further believed that effective mud slurries can be developed with as little as five parts of water (by volume) to one part of clay, and, as high as 15 parts of water (by volume) to one part of clay. Additionally, it is believed that as little as one part of water blocking material (by volume) per five parts of clay can also be an effective water barrier. Moreover, it is also believed that as little as 0.002 lb./gal. of caustic soda added to the water for obtaining the mud slurry can be effective in reducing water loss from the mud slurry. The mud slurry should be thick enough that it will: (a) adhere to the vertical surfaces of the sandbags; (b) hold any included blocking material in suspension; and (c) be thick enough that it will not flow downward. Note that cement mixer trucks commonly used in the construction industry can be used to mix the mud slurry and deliver it to the sandbag dike sites to be treated according to the present invention.

Accordingly, once the mud slurry is mixed and provided at the dike site, the mud slurry is applied to the river side of the exposed sandbags before the flood water level has reached them. Trailer mounted pumps commonly used in the construction industry to pump cement can also be used to apply the mud slurry to the dike. That is, hoses attached to such pumps are used to jet the mud slurry onto the exposed sandbag surfaces prior to the flood water reaching the sandbags. Thus, as the flood waters rise over the sandbags, the mud slurry coating reduces the water flow rate through both woven plastic fabric sandbags and cloth sandbags as well as through any interstice pathways which exist around sandbags, including non-porous plastic.

Immediately after the mud slurry application to the sandbags, the mud coated sandbags are covered with plastic sheeting, primarily to prevent rain from washing the mud away. However, in cases where the rising flood water is not expected to be accompanied by rain, the plastic sheeting may be eliminated entirely. If possible, the plastic sheeting used should be in long rolls with a width a little greater than the height of the dike in order that a long section of dike can be covered with a single piece. The sheeting is anchored in place with sandbags or rocks and no attempt is made to seal the edges to keep the flood waters out.

The plastic sheeting serves several additional purposes:

1. Protects the mud coatings from damage by objects being transported by the flood waters.
2. Retards drying of the mud coatings which are most effective wet.
3. Keeps the mud slurry close to the sandbags.
4. Keeps any detached mud material in close proximity to the sandbags where it may be drawn to points of leakage.
5. Very importantly, facilitates and makes more effective possible repairs to dikes after the sandbags have become submerged. That is, hoses can be inserted between the sandbags and the plastic sheeting, and a thick mud slurry containing blocking materials can be introduced at points of excessive flood water leakage. Note that after the flood waters cover the bags, the mud coating is held in place by the hydrostatic pressure differential across the coating.

EXAMPLES

Example 1.

A container was covered with a woven plastic sandbag fabric used in a sandbag dike and then submerged in water. With no mud slurry on the fabric covering the container opening, the container filled in about 30 seconds. With a mud slurry according to the present invention on the fabric covering the same container opening, 1/20 of the container filled in 5 minutes. The mud slurry for this example was prepared as follows:

(a) Water was mixed with NaOH 0.02 lbs/gal. The result was then mixed with bentonite, 1 part bentonite to 10 parts water by volume providing a bentonite mud.

(b) Then sawdust (loose, not compacted), 6 parts sawdust to 1 part bentonite by volume, was mixed into the bentonite mud to yield a mud slurry according to the present invention.

Example 2.

A wire bowl-shaped container was lined with approximately one square foot of woven plastic sandbag fabric also previously used in a sandbag dike. With no coating on the plastic fabric, 2 cups of water passed through in less than 10 seconds. After a bentonite mud (1 part bentonite to 12 parts water) coating was applied, 2 cups of water passed through in about 12 seconds, the water flushing the bentonite mud through with it. In subsequent tests, the mud was allowed to dry. When 2 cups of water were provided in the container, the water passed through the container in about 1 minute. Upon allowing the mud to dry again, and again providing 2 cups of water in the container, the water passed through a little more slowly. Accordingly, it is believed that if a bentonite mud alone is used, then it is desirable to allow the mud to dry.

Example 3.

In another experiment, a thicker bentonite mud slurry (1 part bentonite to 9 parts water) was spread on another sample of the sandbag plastic fabric lining the wire bowl-shaped container, and the slurry was allowed to dry. Subsequently, 2 cups of water provided in the container passed through the mud slurry coated fabric in 3 minutes, with an increasing flow rate over time. Following this, 2 more cups of water were provided in the container, and this water passed through the mud slurry coated fabric in 1 minute. Additionally, another 2 cups of water also passed through the mud slurry coated fabric in 1 minute. Thus, it is believed that as demonstrated in the present experiment, a thicker mud slurry, without additional additives, may result in little or no decrease in flow rate through the mud slurry coated fabric over thinner mud slurries. However, bentonite mud slurries having 1 part bentonite to 8 to 15 parts of water by volume are believed desirable for utilizing the present invention.

Example 4.

In another experiment, a mud slurry having 1 part bentonite to 12 parts water and 2 parts sawdust (by volume) was prepared. Subsequently, the slurry was allowed to dry on a comparable sandbag fabric to those above also lining a similar wire bowl-shaped container. Two cups of water were then provided in the container, the water passed through the slurry coated fabric in 5 minutes. Following this, 2 additional cups of water were provided in the container, this water passed through in about 17 minutes. Then an additional 2 cups of water were provided in the container, this water passed through in about 19 minutes. As demonstrated in this experiment, it is believed that the addition of sawdust greatly diminishes rate of flow water through a bentonite mud slurry. Additionally, it is believed that as the sawdust is exposed to increased amounts of water, the sawdust becomes more effective in inhibiting the flow of water through the slurry coated sandbag fabric.

Example 5.

In yet another experiment, a mud slurry having 1 part bentonite to 12 parts water and 2 parts sawdust (by volume) was prepared. The slurry was applied to a sample of the sandbag fabric lining a wire bowl-shaped container as above, and was not allowed to dry. After passing 2 cups of water through the slurry coated fabric, a second 2 cups of water was passed therethrough, this second 2 cups of water passed through the slurry coated fabric in about 18 minutes.

Accordingly, as demonstrated herein, it is believed that if sawdust is included in a bentonite mud slurry, it is not necessary that the resulting slurry be allowed to dry in order to become an effective water barrier.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiment described hereinabove is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. A method of reducing water from flowing through a sandbag dike, comprising:

preparing a mud slurry having a mixture of water and clay;

incorporating said mud slurry into the dike;

applying plastic sheeting on a side of the dike contacting the water to be retained.

2. A method as claimed in claim 1, wherein said clay includes bentonite.

3. The method as claimed in claim 1, wherein said step of preparing includes mixing one part clay with 5 to 15 parts of water by volume.

4. A method as claimed in claim 1, wherein said step of preparing includes adding a water blocking material to said mud slurry.

5. A method as claimed in claim 4, wherein said step of adding includes providing at least one part of water blocking material by volume per said five parts of clay.

6. A method as claimed in claim 4, wherein said water blocking material is one of: sawdust, cottonseed hulls, and nut shells, leaves, cone fiber, shredded cellophane, and mica flakes.

7. A method as claimed in claim 1, wherein said step of preparing includes adding a water loss reducing chemical to said mud slurry.

8. A method as claimed in claim 7, wherein said water loss reducing chemical is caustic soda having a chemical representation of NaOH.

9. A method as claimed in claim 8, wherein at least 0.002 lbs./gal. of said caustic soda is added to the water of said mud slurry.

10. A method as claimed in claim 1, wherein said step of incorporating includes applying said mud slurry onto said side of the dike contacting the water retained by the dike.

11. A method as claimed in claim 10, wherein said step of applying includes jetting said mud slurry.

12. A method as claimed in claim 1, wherein said step of incorporating includes jetting said mud slurry into interstices of the dike.

13. A method as claimed in claim 1, wherein said step of incorporating includes injecting said mud slurry between sandbags of the dike and the plastic sheeting.

14. A method as claimed in claim 1, further including a step of providing said mud slurry to a dike site using a cement mixing truck.

* * * * *